US007491184B2

(12) United States Patent
Huang

(10) Patent No.: US 7,491,184 B2
(45) **Date of Patent: *Feb. 17, 2009**

(54) PERCUSSIVE MASSAGER WITH ECCENTRIC DRIVE

(75) Inventor: Charles Huang, Taipei (TW)

(73) Assignee: HoMedics, Inc., Commerce Township, MI (US)

( * ) Notice: Subject to any disclaimer, the term of this patent is extended or adjusted under 35 U.S.C. 154(b) by 230 days.

This patent is subject to a terminal disclaimer.

(21) Appl. No.: 11/303,537

(22) Filed: Dec. 16, 2005

(65) Prior Publication Data

US 2006/0094994 A1 May 4, 2006

Related U.S. Application Data

(63) Continuation of application No. 10/187,697, filed on Jul. 2, 2002, now Pat. No. 6,981,954, which is a continuation of application No. 09/475,810, filed on Dec. 30, 1999, now Pat. No. 6,500,135.

(60) Provisional application No. 60/114,490, filed on Dec. 31, 1998.

(51) Int. Cl.
*A61H 1/00* (2006.01)
*A61H 23/02* (2006.01)

(52) U.S. Cl. ..... 601/103; 601/111

(58) Field of Classification Search ..... 601/101, 601/103, 107, 108, 110, 111, 129, 130, 131, 601/134, 135

See application file for complete search history.

(56) References Cited

U.S. PATENT DOCUMENTS 775,813 A 11/1904 Fornander
1,098,337 A 5/1914 Soukup
1,269,803 A 6/1918 Elmen et al.
1,339,179 A 5/1920 Elmen
1,377,140 A 5/1921 North
1,657,765 A 1/1928 Pasque (Continued)

FOREIGN PATENT DOCUMENTS

EP 0001833 A2 5/1979

(Continued)

*Primary Examiner*—Danton DeMille
(74) *Attorney, Agent, or Firm*—Brooks Kushman P.C.

(57) ABSTRACT

A percussive massager is provided having a housing including a massage head portion and a handle portion, and a motor support unit affixable within the massage head portion. A motor is supported by the motor support unit, and an output shaft rotatably driven by the motor protrudes from the motor on either side thereof. The massager further includes a pair of vertical connecting rods each having a first end and a second end, wherein the first ends are operably connected to the output shaft such that rotation of the output shaft causes the connecting rods to reciprocate axially in an asynchronous manner. A rocker arm is attachable to the motor support unit at a central pivot axis thereof, wherein the rocker arm is operably connected to the second ends of the connecting rods and is moved about the central pivot axis by rotation of the output shaft. At least two massage nodes are operably connected to the rocker arm to form a massage surface, wherein the massage nodes are moved asynchronously toward and away from the massage head portion by each of the connecting rods to provide a percussive massage effect.

21 Claims, 3 Drawing Sheets

U.S. PATENT DOCUMENTS

| | | | |
|---|---|---|---|
| 1,888,510 | A | 11/1932 | Mashek |
| 2,138,815 | A | 12/1938 | Eberly |
| 2,466,659 | A | 4/1949 | Korpela |
| 2,964,037 | A | 12/1960 | Johnston |
| 3,094,119 | A | 6/1963 | Avedissian |
| 3,374,784 | A | 3/1968 | Brent et al. |
| 3,467,080 | A | 9/1969 | McNair |
| 3,536,064 | A | 10/1970 | Kuroda et al. |
| 3,548,811 | A | 12/1970 | Wilson |
| 3,626,934 | A | 12/1971 | Andis |
| 3,672,355 | A | 6/1972 | Ogawa et al. |
| 3,802,423 | A | 4/1974 | Pfaendler |
| 3,881,470 | A | 5/1975 | Glore |
| 4,025,809 | A | 5/1977 | Teranishi |
| 4,069,816 | A | 1/1978 | Yamamura et al. |
| 4,079,733 | A | 3/1978 | Denton et al. |
| 4,088,128 | A | 5/1978 | Mabuchi |
| 4,098,266 | A | 7/1978 | Muchisky et al. |
| 4,149,530 | A | 4/1979 | Gow |
| 4,150,668 | A | 4/1979 | Johnston |
| 4,414,963 | A | 11/1983 | Kunz |
| 4,512,339 | A | 4/1985 | McShirley |
| 4,718,408 | A | 1/1988 | Barreiro |
| 4,730,605 | A | 3/1988 | Noble et al. |
| D299,863 | S | 2/1989 | Noble et al. |
| 4,827,914 | A | 5/1989 | Kamazawa |
| 5,088,474 | A | 2/1992 | Mabuchi et al. |
| 5,159,922 | A | 11/1992 | Mabuchi et al. |
| 5,361,437 | A | 11/1994 | Zhu et al. |
| 5,447,491 | A | 9/1995 | Bellandi |
| 5,716,332 | A | 2/1998 | Noble |
| 5,772,615 | A | 6/1998 | Elder et al. |
| 5,803,916 | A | 9/1998 | Kuznets et al. |
| 5,923,107 | A | 7/1999 | Franck |
| 5,935,089 | A | 8/1999 | Shimizu |
| D415,838 | S | 10/1999 | Noble |
| 6,102,875 | A | 8/2000 | Jones |
| 6,165,145 | A | 12/2000 | Noble |
| 6,500,135 | B2 | 12/2002 | Huang |
| 6,733,466 | B2 | 5/2004 | Huang |
| 6,981,954 | B2 | 1/2006 | Huang |

FOREIGN PATENT DOCUMENTS

| | | | |
|---|---|---|---|
| GB | 498228 | | 12/1938 |
| JP | H10216191 | A | 8/1998 |

Fig. 1
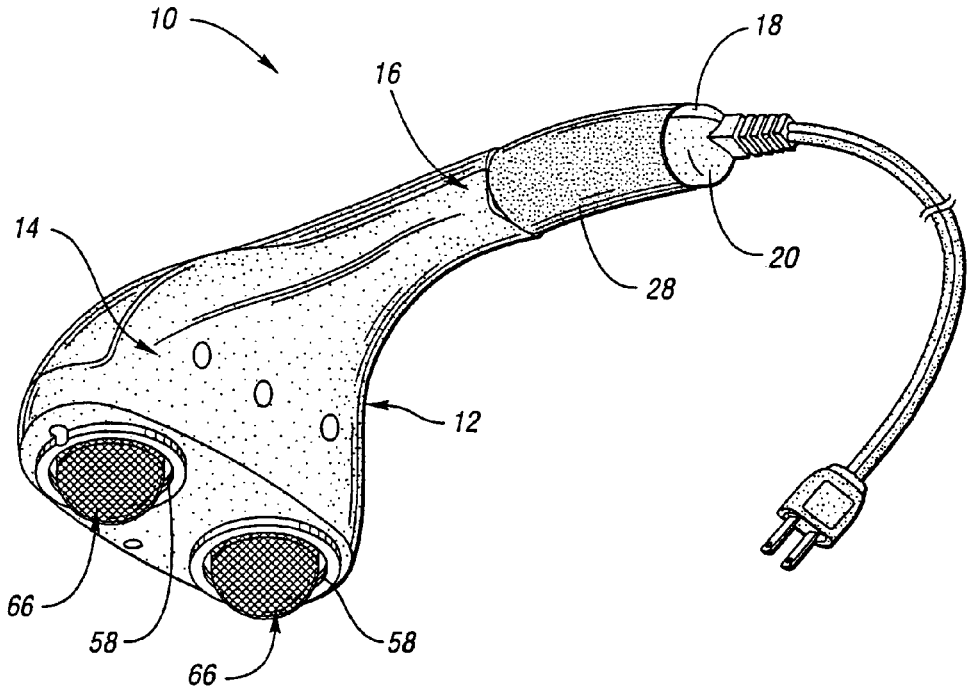
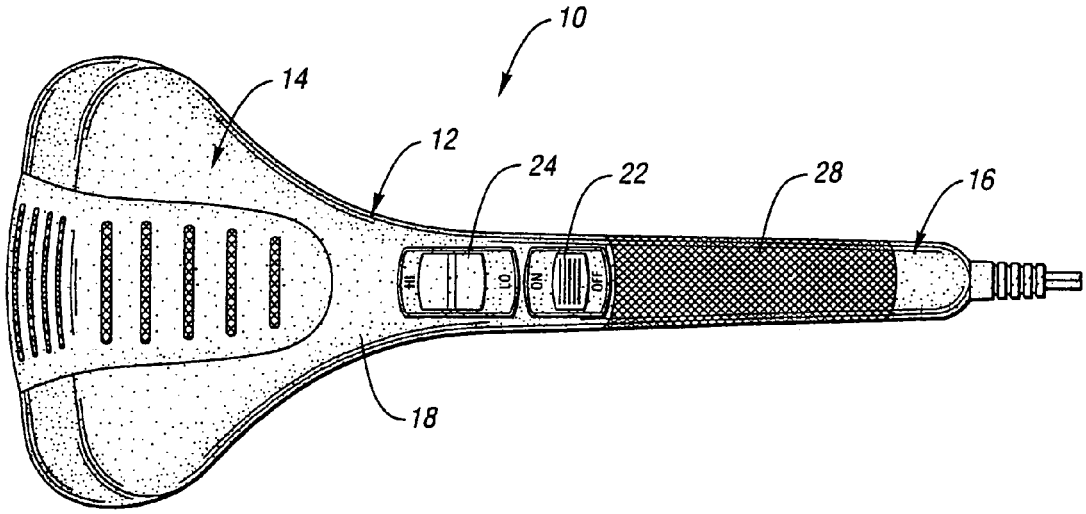
Fig. 2

72
66
68
58
20
64
60
62
52
56
54
50
32
34
46
36
48
40
30
26
22
38
42
18
28
24

PERCUSSIVE MASSAGER WITH ECCENTRIC DRIVE

CROSS-REFERENCE TO RELATED APPLICATIONS

This application is a continuation of U.S. Ser. No. 10/187,697 filed Jul. 2, 2002 (now U.S. Pat. No. 6,981,954 issued on Jan. 3, 2006) which, in turn, is a continuation of U.S. application Ser. No. 09/475,810 filed Dec. 30, 1999 (now U.S. Pat. No. 6,500,135 B2 issued on Dec. 31, 2002) which, in turn, claims the benefit of U.S. provisional application Ser. No. 60/114,490, filed Dec. 31, 1998.

BACKGROUND OF THE INVENTION

1. Field of the Invention

This invention relates to a massager which exerts a percussive massage effect.

2. Background Art

Power-operated massagers are often used to treat muscle tension and fatigue. Massagers that exert a percussive effect on the body are preferred over massagers which generate a rubbing action, since the latter type of massager can cause irritation or other discomfort to the recipient.

U.S. Pat. No. 4,730,605 issued to Noble et al. discloses one such percussive massager. The massager has a casing with two handles, and is intended for two-handed operation. U.S. Pat. No. 5,716,332 issued to Noble discloses a similar percussive massager that is designed so as to be capable of use for self massage. In both massagers, the massage head is coupled to a base structure for pivotal rocking movement about a pivot axis for exerting a percussive massage effect.

More particularly, the massagers referenced above each include a weight is affixed to the drive shaft of the motor. The weight has a vertical arm attached eccentrically thereto, such that rotation of the drive shaft causes the vertical arm to move axially. The vertical arm is coupled to a first massage formation, which is in turn connected to a second massage formation by a rigid surface. Movement of the vertical arm causes the first massage formation to be moved upwardly and downwardly, and in turn causes the second massage formation to be moved in the opposite direction about a central pivot. Unfortunately, this design has the disadvantage that movement of the first and second massage formations are both controlled by the same vertical arm and are not moved independently. Consequently, if the vertical arm breaks, the movement of both massage formations ceases.

SUMMARY OF THE INVENTION

Therefore, it is a principal object of the present invention to provide a percussive massager having massage nodes that are moved independently.

Accordingly, a percussive body massager having independently movable massage nodes is provided. The massager has a housing that includes a massage head portion and a handle portion, and a motor support unit affixed within the massage head portion. A motor is supported by the motor support unit, and rotatably drives an output shaft that protrudes from either side of the motor. The massager further includes a pair of connecting rods each having a first end and a second end. The first ends of the connecting rods are operably connected to the output shaft such that rotation of the output shaft causes the connecting rods to reciprocate axially in an asynchronous manner. A rocker arm is attached to the motor support unit at a central pivot axis thereof and is operably connected to the second ends of the connecting rods. During rotation of the output shaft, the rocker arm is moved about the central pivot axis. At least two massage nodes are operably connected to the rocker arm to form a massage surface, wherein the massage nodes are moved asynchronously toward and away from the massage head portion by each of the connecting rods to provide a percussive massage effect.

In accordance with a preferred embodiment of the present invention, the pair of connecting rods are operably connected to the output shaft by a pair of crank arms affixed to each end of the output shaft. To provide the asynchronous movement, one connecting rod is attached to one crank arm in a first offset location with respect to a longitudinal axis of the output shaft, and the other connecting rod is attached to the other crank arm in a second offset location with respect to the longitudinal axis of the output shaft. Preferably, the first offset location is 180 degrees from the second offset location.

In further accordance with the preferred embodiment, the rocker arm includes connectors, such as screws, extending therefrom for securing the massage nodes to the rocker arm. Advantageously, the massage nodes can then be removed and interchanged with another set of massage nodes. The rocker arm preferably further includes protrusions and corresponding cavities formed in transversely spaced apart end portions of the rocker arm which are operably connected to the second ends of the connecting rods. Resilient sleeves are affixed to the interior of the housing and sized to receive the protrusions, and the sleeves are operable to expand and contract in response to movement of the rocker arm by the motor. In a preferred embodiment, the output shaft can be rotated at a plurality of speeds through actuation of a variable speed lever.

Still further, the housing is preferably constructed from a plastic material and assembled from a top housing part and a bottom housing part. According to a preferred embodiment, the massage nodes are hemispherically shaped, have an internal frame constructed from a plastic material, and have an exterior surface constructed from a resilient material to impart the percussive massage effect.

The above objects and other objects, features, and advantages of the present invention are more readily understood from a review of the attached drawings and the accompanying specification and claims.

BRIEF DESCRIPTION OF THE DRAWINGS

FIG. 1 is a bottom perspective view of the percussive body massager in accordance with the present invention;

FIG. 2 is a top plan view of the percussive body massager of FIG. 1;

DETAILED DESCRIPTION OF THE PREFERRED EMBODIMENT(S)

Figure 3:
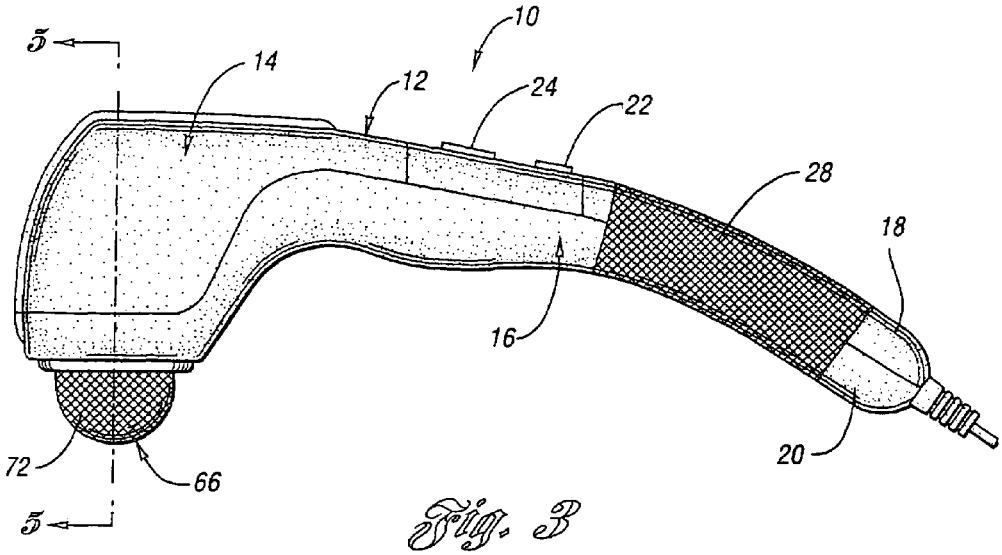
FIG. 3 is a side elevational view of the percussive body massager of FIG. 1.

Referring to FIGS. 1-3, a percussive body massager in accordance with the present invention is shown and indicated by reference numeral 10. Massager 10 comprises a housing 12 formed generally as two portions, a massage head 14 and a handle 16. Housing 12 is preferably constructed from a plastic material and is assembled from two parts, a top part 18 and a bottom part 20. Massager 10 is advantageously constructed to be light enough for an operator to use it with only one hand if desired.

As shown in FIGS. 1-3, handle portion 16 is preferably elongate and extends perpendicularly from massage head 14. Handle 16 preferably contains slidable switches for operator use, as best shown in the top plan view of FIG. 2, which are located on top housing part 18 for convenient operator viewing. The switches include an on/off switch 22 and a variable speed lever 24 electrically connected to a circuit board assembly 26 (best shown in FIG. 4). Advantageously, variable speed lever 24 is not limited to discrete speed levels, but rather can be slidingly located at many different massage speeds to achieve the precise speed desired by the operator. Massager 10 of the present invention is capable of providing a high intensity massage of approximately 3,000 pulses per minute. To adjust the intensity of the massage, an operator simply slides speed lever 24 in one direction for higher intensity or in the opposite direction for lower intensity. Of course, massager 10 can alternatively incorporate on/off and speed selection switches other than slidable type switches.

Still referring to FIGS. 1-3, handle 16 is designed to have an arc, thereby facilitating the use of massager 10 by an operator on his/her own back. In addition, handle 16 is also preferably contoured to facilitate a user's grasp and is provided with a foam cushion 28 to provide an operator with easy and comfortable grip.

Figure 5:
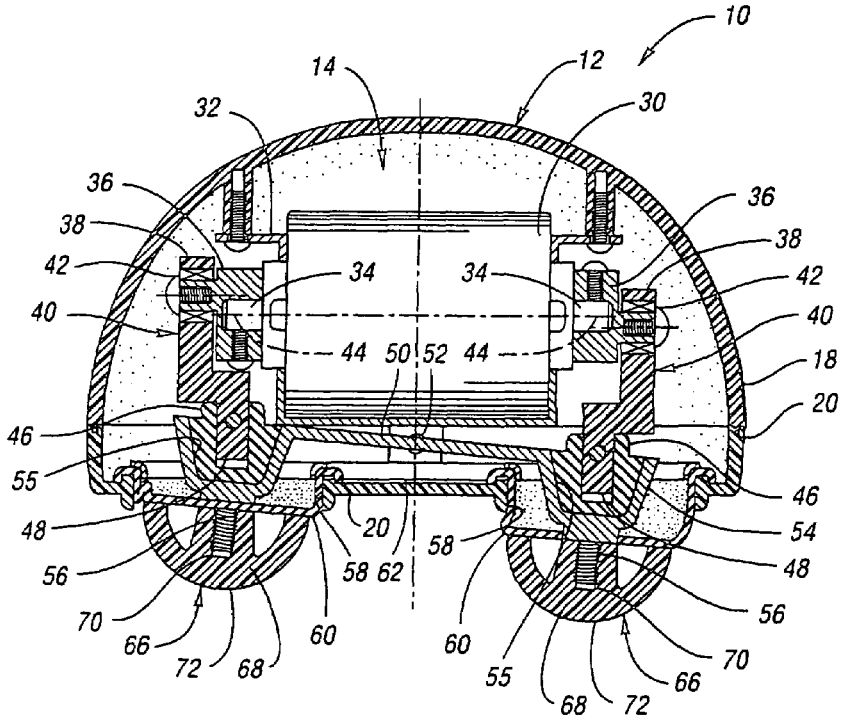
FIG. 5 is an end, cross-sectional view of the massage head portion of the percussive body massager taken along line 5-5 of FIG. 3.
Figure 4:
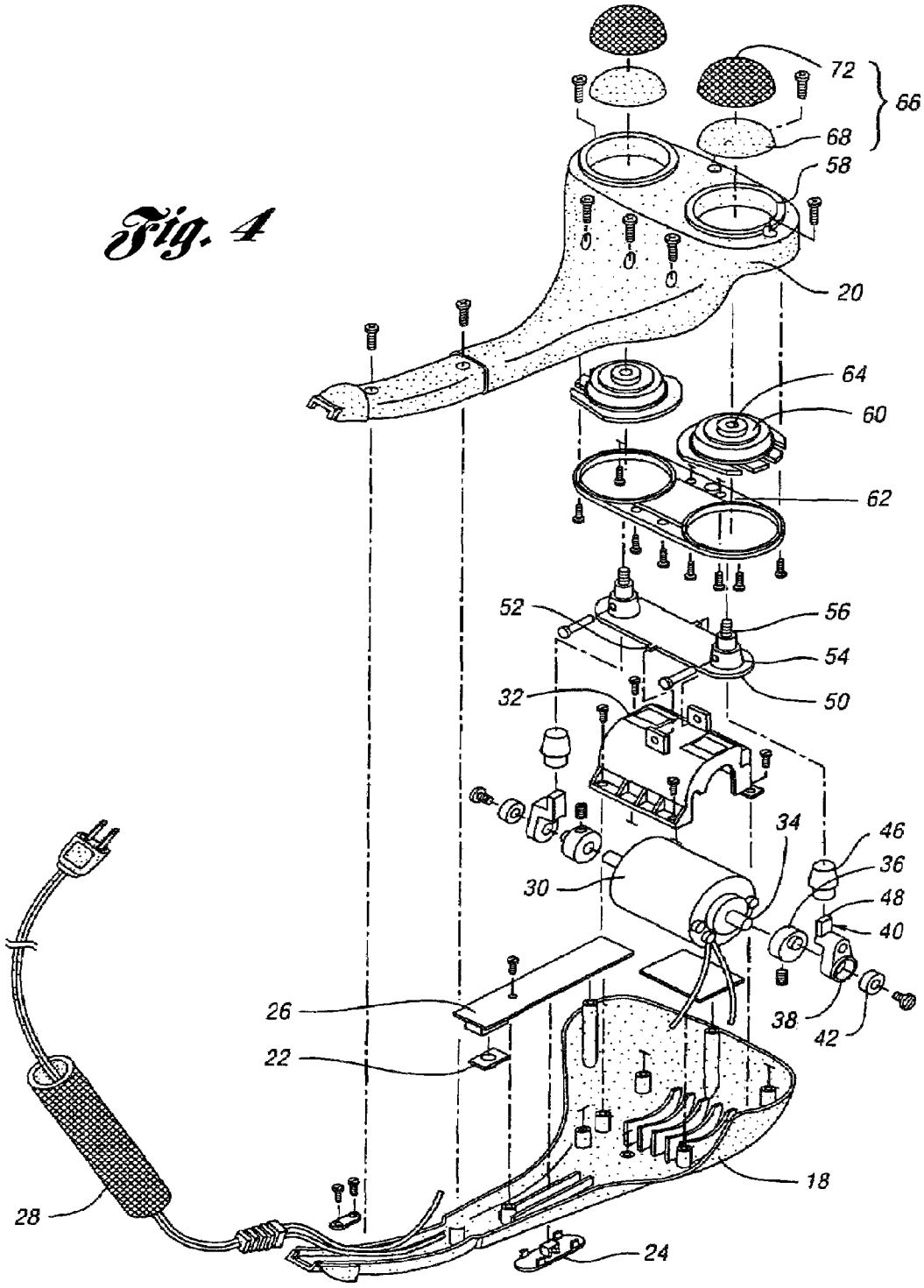
FIG. 4 is an exploded view of the percussive body massager of the present invention.

Referring now to the exploded view of FIG. 4 and the cross-section view of FIG. 5 (taken along line 5-5 of FIG. 3), massager 10 is provided with an electric motor 30 which is disposed within massage head portion 14 of top housing part 18. Massager 10 is generally symmetrical about a plane which is perpendicular to the motor axis. Motor 30 is partially surrounded and preferably suspended above a massage surface, which is described below, by a motor support unit 32 affixed within massage head 14. An output shaft 34 is rotatably driven by motor 30 and protrudes from motor 30 on either side thereof. A crank arm 36 is affixed to each end of output shaft 34 adjacent motor 30, so that crank arms 36 rotate along with output shaft 34. To the outside of each crank arm 36, a first end 38 of a vertical connecting rod 40 is affixed eccentrically, preferably with a rotary bearing 42 (best shown in FIG. 4) in between crank arm 36 and connecting rod 40.

In operation, the rotation of output shaft 34 by motor 30 causes each connecting rod 40 to reciprocate axially. More specifically, on one side of motor 30 the connecting rod 40 is attached to the crank arm 36 in a first offset location, such as above a longitudinal axis 44 of output shaft 34, depicted as the left connecting rod 40 in FIG. 5. On the other side of motor 30 the connecting rod 40 is attached to the crank arm 36 at a second offset location. The second offset location is preferably 180 degrees from the first offset location, such as below longitudinal axis 44 of output shaft 34 as depicted for the right connecting rod 40 in FIG. 5. Therefore, as output shaft 34 rotates, connecting rods 40 are moved up and down asynchronously due to their different eccentric attachment locations, and therefore the crank arms 36 and the corresponding connecting rods 40 operate as eccentric drives.

Still referring to FIGS. 4 and 5, a stud 46, preferably formed from a resilient material such as rubber, is affixed to a second end 48 of each connecting rod 40. Rubber studs 46 are in turn connected to an elongated rocker arm 50, which is attached to motor support unit 32 at a central pivot axis 52. More specifically, rocker arm 50 includes transversely spaced apart end portions 53 having protrusions 54 and corresponding cavities 55 aligned and sized to receive rubber studs 46. Rubber studs 46, and therefore connecting rods 40, are affixed to either end of rocker arm 50 in this manner, such that rocker arm 50 is moved about central pivot axis 52 upon the rotation of output shaft 34. Since each connecting rod 40 has a separate attachment to rocker arm 50, each connecting rod 40 can operate independently to cause the movement of rocker arm 50 about central pivot axis 52. Therefore, this design allows massager 10 of the present invention to continue to function and exert its percussive massage effect even if one connecting rod 40 or its attachments becomes inoperative for any reason.

As shown in FIGS. 4 and 5, each protrusion 54 has a connector, such as screw 56, extending therefrom. In massage head portion 14 of bottom housing part 20, two transversely spaced apart circular apertures 58 are formed. Sleeves 60 are affixed to the interior of bottom housing part 20, covered by a mounting plate 62 to provide support, and positioned to extend through apertures 58 thereby generally sealing apertures 58. In a preferred embodiment, the interior surface of sleeves 60 is formed to mate with the design of protrusions 54, and sleeves 60 are annular and provided with a hole 64 through which screws 56 extending from protrusions 54 can project. Sleeves 60 are composed of a resilient material such as rubber, and are constructed to be able to expand and contract through apertures 58 as dictated by the movement of rocker arm 50 in response to motor 30.

Therefore, screws 56 extending from protrusions 54 project out of bottom housing part 20 through sleeves 60 and apertures 58. At least two massage nodes 66, preferably hemispherically-shaped, are provided to be removably fastened to screws 56 and extend at least partially outside of housing 12 in order to provide the massage surface (see FIGS. 1-5). It is understood, of course, that more than two massage nodes 66 may be included in the massage surface and that massage nodes 66 can have any shape suitable to impart the desired massage effect. Massage nodes 66 preferably have a plastic, generally hemispherical internal frame 68 that includes a threaded cylinder 70 such that each massage node 66 can be fastened to each screw 56. Exterior surface members 72 of massage nodes 66 comprise a resilient, preferably rubber material. Preferably, alternate sets (not shown) of massage nodes 66 are provided for attachment to massager 10 of the present invention. The sets of massage nodes 66 would be of different densities to provide the options of soft, medium, or hard massage application. To change to a different set, an operator can simply unscrew the set that is currently attached to massager 10 via screws 56 and screw in the desired set.

In summary, percussive body massager 10 of the present invention operates as follows. Motor 30 rotatably drives output shaft 34, which in turn rotates affixed crank arms 36 to cause asynchronous, axial movement of eccentrically attached connecting rods 40. Rubber studs 46 affixed to connecting rods 40 interface with rocker arm 50 to cause it to move back and forth about its central pivot attachment 52 to motor support unit 32. From protrusions 54 formed in rocker arm 50, screws 56 extend through rubber sleeves 60 designed to expand and contract through apertures 58 formed in massage head portion 14 of bottom housing part 20. Massage nodes 66 which form the massage surface are fastened to these screws 56, such that the massage nodes 66 are moved asynchronously and independently by connecting rods 40 toward and away from massage head 14 to provide a percussive massage effect. Advantageously, the design of massager 10 assures that massage nodes 66 will continue to function properly even if one connecting rod 40 becomes inoperative.

It is understood, of course, that while the form of the invention herein shown and described constitutes a preferred embodiment of the invention, it is not intended to illustrate all possible forms thereof. It will also be understood that the words used are words of description rather than limitation, and that various changes may be made without departing from the spirit and scope of the invention disclosed.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A massager comprising:

a housing having an aperture formed therein;

a motor mounted within the housing, the motor having a rotary shaft;

an eccentric drive rotatably connected to the motor shaft at a location eccentrically spaced about an axis of rotation of the motor shaft to cause an output end of the eccentric drive to reciprocate as the motor shaft rotates;

a massage arm operably connected to the housing for oscillation relative to the housing, the massage arm being operably connected to the output end of the eccentric drive, causing the massage arm to oscillate relative to the housing as the eccentric drive output end reciprocates;

a massage formation provided on the massage arm, at least partially projecting from the housing through the aperture; and a flexible sleeve mounted directly to the housing and the massage arm.

2. The massager of claim 1 wherein the flexible sleeve is mounted to the housing aperture.

3. The massager of claim 1 wherein the flexible sleeve extends through the housing aperture external of the housing when the massage arm is oriented away from the housing as the massage arm is oscillated.

4. The massager of claim 1 wherein the flexible sleeve expands and contracts as the massage arm oscillates relative to the housing.

5. The massager of claim 1 wherein the flexible sleeve generally seals the aperture.

6. The massager of claim 1 wherein the massage formation is removably fastened to the massage arm.

7. The massager of claim 1 wherein the massage arm is operably connected to the housing for limited rotation relative to the housing.

8. The massager of claim 1 further comprising a mounting plate for mounting the flexible sleeve to the housing.

9. The massager of claim 1 wherein the flexible sleeve is annular.

10. The massager of claim 1 wherein the flexible sleeve has a central opening sized to enable a connector to pass therethrough for mounting the massage formation to the massage arm.

11. The massager of claim 1 wherein the massage arm includes a connector extending therefrom for securing the massage formation to the massage arm.

12. The massager of claim 1 wherein the massage formation is removable and interchangeable with another massage formation.

13. The massager of claim 1 wherein the massage formation has first and second sides spaced on opposite sides of the massage arm connection with the housing.

14. The massager of claim 1 wherein the massage formation further comprises at least a pair of massage members that are spaced relative to the massage arm connection to the housing to provide a percussive massage effect as the massage arm oscillates.

15. The massager of claim 1 wherein the eccentric drive is counterbalanced relative to the motor.

16. The massager of claim 1 wherein the flexible sleeve is affixed to an interior of the housing.

17. The massager of claim 1 further comprising a stud affixed to the output end of the eccentric drive.

18. The massager of claim 17 wherein the massage arm includes a protrusion and a corresponding cavity that is aligned and sized to receive the stud.

19. The massager of claim 1 wherein the flexible sleeve has a first end mounted directly to the housing and a second end mounted directly to the massage arm.

20. A percussive massager comprising:

a housing having an aperture formed therein;

a motor mounted within the housing, the motor having a rotary output shaft;

a connecting rod having a first end and a second end, wherein the first end of the connecting rod is rotatably connected to the output shaft at a location eccentrically spaced about an axis of rotation of the output shaft to cause the second end of the connecting rod to reciprocate as the output shaft rotates;

a massage arm operably connected to the housing for oscillation relative to the housing, the massage arm being operably connected to the second end of the connecting rod, causing the massage arm to oscillate relative to the housing as the connecting rod second end reciprocates;

two transversely spaced apart massage nodes mounted to the massage arm; and a flexible annular sleeve mounted to the housing aperture and the massage arm for generally sealing the aperture.

21. A percussive massager comprising:

a housing having two transversely spaced apart apertures formed therein;

a motor transversely mounted within the housing, the motor having a rotary output shaft;

a connecting rod having a first end and a second end, wherein the first end of the connecting rod is rotatably connected to the output shaft at a location eccentrically spaced about an axis of rotation of the output shaft to cause the second end of the connecting rod to reciprocate as the output shaft rotates;

an elongated rocker arm having a central pivot axis, wherein the rocker arm is pivotably mounted relative to the housing and includes a pair of transversely spaced apart end portions, one end portion being operably connected to the second end of the connecting rod, causing the rocker arm to rock about the central pivot axis as the connecting rod second end reciprocates;

two transversely spaced apart massage nodes which at least partially project from the housing through the apertures, each massage node operably connected to one of the spaced apart end portions of the rocker arm;

a pair of flexible annular sleeves mounted to the housing and generally sealing the apertures, each sleeve having a central opening sized to enable a connector to pass therethrough for mounting the massage node; and a mounting plate for mounting the annular sleeves to the housing;

wherein the massage nodes move asynchronously toward and away from the housing providing a percussive massage effect in response to rotation of the output shaft.

* * * * *